US005505631A

United States Patent [19]

Schauer et al.

[11] Patent Number: 5,505,631

[45] Date of Patent: Apr. 9, 1996

[54] DEVICE TO CONNECT AN EXPLOSIVE CHARGE WITH AN ELECTRIC CURRENT SOURCE

[75] Inventors: Friedrich Schauer, Heroldsberg; Andreas Neuner, Nürnberg, both of Germany

[73] Assignee: kabelmetal electro GmbH, Germany

[21] Appl. No.: 258,744

[22] Filed: Jun. 10, 1994

[30] Foreign Application Priority Data

Jul. 16, 1993 [DE] Germany ..... 43 23 839.4

[51] Int. Cl.[6] ..... H01R 13/703

[52] U.S. Cl. ..... 439/188; 200/51.1

[58] Field of Search ..... 439/188; 200/51.1

[56] References Cited

U.S. PATENT DOCUMENTS

| | | | |
|---|---|---|---|
| 3,512,043 | 5/1970 | Jaksoo et al. | 439/188 |
| 4,070,557 | 1/1978 | Ostapovich | 200/51.1 |
| 4,894,019 | 1/1990 | Howard | 439/188 |
| 4,906,203 | 3/1990 | Margrave et al. | 439/188 |
| 5,281,158 | 1/1994 | Lin | 439/188 |

FOREIGN PATENT DOCUMENTS

| | | |
|---|---|---|
| 2220102 | 9/1974 | France . |
| 1613706 | 5/1971 | Germany . |
| 2176879 | 1/1987 | United Kingdom . |
| 2245775 | 1/1992 | United Kingdom . |

*Primary Examiner*—Neil Abrams

*Attorney, Agent, or Firm*—Ware, Fressola, Van Der Sluys & Adolphson

[57] ABSTRACT

A connecting device couples an explosive charge, triggerable by electric current, to a current source. A two core electrical line has the explosive charge at one end, the current source at the other end and the connecting device in between. The connecting device includes a plug (4) with two plug pins (7,8) extending parallel to each other. In the connected state of the connecting device, a counter plug (5) matingly receives the two plug pins. The plug (4) has a cavity (14) between the two plug pins (7,8) in which a short-circuit element (11) made from a resilient metal is provided. The short-circuit element (11) is moveable relative to the plug pins (7,8) between an operative position and an inoperative position. The short-circuit element (11) extends, from its operative position, which is determined by its shape and resilience and corresponds to the disconnected state of the connecting device, into the space provided for the counter plug in the connected state of the connecting device, by a shorter distance in relation to the length of the plug pins (7,8), thereby electrically contacting the plug pins (7,8). In its inoperative position, the short-circuit element (11) is recessed in the cavity (14) of the plug (4) out of electrical contact with the plug pins (7,8) and abutting the front of the counter plug situated in the connecting device in its connected state.

9 Claims, 2 Drawing Sheets

DEVICE TO CONNECT AN EXPLOSIVE CHARGE WITH AN ELECTRIC CURRENT SOURCE

BACKGROUND OF THE INVENTION

1. Technical Field

The invention is directed to a connecting device to couple an explosive charge, triggerable by electric current, to a current source and, more particularly, to such a connecting device used to prevent accidental triggering of the explosive charge for an airbag of a motor vehicle.

2. Description of the Prior Art

To trigger an airbag in a motor vehicle, an explosive charge is used to provide rapid deployment of an airbag in a motor vehicle. For repair and maintenance purposes, it may be required to separate the connection between the explosive charge and a current source used to trigger the explosive charge. To do this, a counter plug is detached from a plug which is attached to an electrical line to the explosive charge. By having the plug disconnected, it is possible that the explosive charge may be triggered accidently by random electrical charges in the environment such as static electricity.

SUMMARY OF THE INVENTION

An object of the present invention is to provide a connecting device which allows the explosive charge to be protected against influence of random electrical charges in the environment.

This object is achieved according to the invention by providing a short-circuit element made of resilient metal in the area between two plug pins of the plug for the explosive charge. The short-circuit element is placed in the plug and moveable relative to the plug pins in a direction of the axes thereof between an operative position and an inoperative position. The short-circuit element extends in its operative position, which is determined by its shape and resilience and corresponds to the disconnected state of the connecting device, into the space provided for a counter plug in the connected state of the connecting device, by a shorter distance in relation to the length of the plug pins, thereby electrically connecting the plug pins. The short-circuit element in its inoperative position is recessed in a cavity of the plug out of electrical contact with the plug pins and abutting the front of the counter plug when the counter plug is inserted fully into the space provided in the plug.

In the connecting device of the present invention, the electric circuit to the explosive charge is automatically short-circuited, if the plug is disconnected from the counter plug. Then, the explosive charge cannot be triggered by a random electrical charge in the environment.

The plug and counter plug are dimensionally sized so that the short-circuit element is only removed from its operative position by the counter plug if electrical contacts in the counter plug already are in contact with the pins of the plug. In achieving the connected state of the connecting device, the short-circuit element is moved to its inoperative position, no longer in contact with the pins, when the counter plug is inserted into the plug. When the counter plug is disconnected from the plug, the short-circuit element follows the movement of the counter plug because of the shape and resilience of the short-circuit element. Before the counter plug is completely pulled off the pins, the short-circuit element reaches its operative position where it electrically contacts both of the plug pins. In this manner, the electric circuit of the explosive charge is never open since it is either short-circuited or connected to the counter plug. In addition, the short-circuit element moves only a short distance between its operative and inoperative positions so as to guarantee its effectiveness.

DETAILED DESCRIPTION OF THE INVENTION

Figure 1:
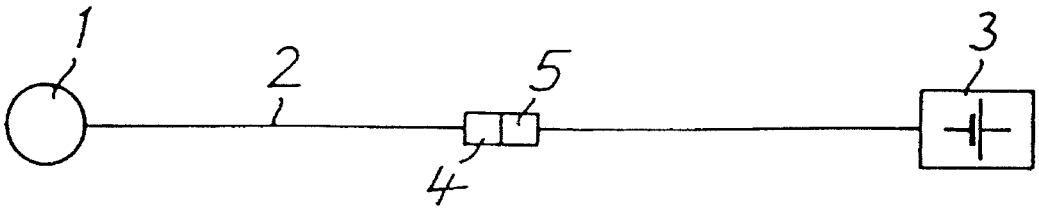
FIG. 1 is a diagrammatical view of a connecting device according to the invention in a two-core electrical line between an explosive charge and a current source.

An explosive charge 1, triggerable by electric current, is connected to a current source 3 via a two-core electrical line 2. In the line 2, a connecting device comprising a plug 4 and a counter plug 5 is installed. The plug 4 is on the side of the explosive charge 1, whereas the counter plug 5 is placed on the side of the current source 3.

Figure 2:
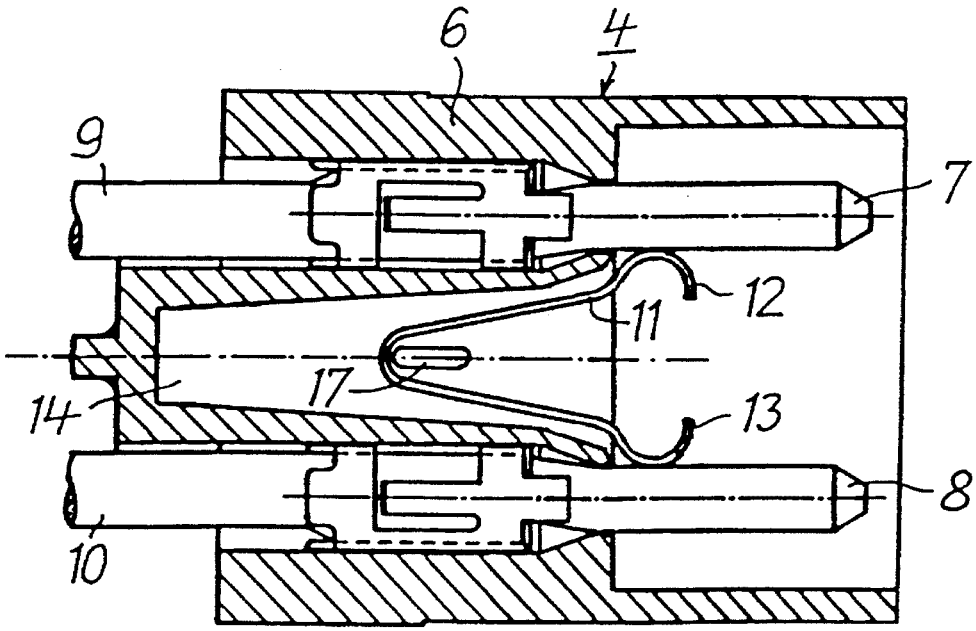
FIG. 2 is a cross-sectional view through a plug of the connecting device of the present invention.

The plug 4 has, according to FIG. 2, an insulation body 6, to which two plug pins 7 and 8 are attached. Connected to the plug pins 7 and 8 are electrical conductors of two cores 9 and 10 of the electrical line 2. Mounted in an insulation body 6 of the plug 4 is a short-circuit element 11. The short-circuit element 11 is placed between the two plug pins 7 and 8.

The short-circuit element 11 is constructed as a generally V-shaped bow, as it is shown in FIG. 2. Each of its free ends has a semicircularly shaped arc 12 and 13, pointing convexly to the outside. The short-circuit element 11 is made of a resilient material such as steel. As shown in FIG. 2, in the disconnected state of the plug 4 and the connecting device, the short-circuit element 11 assumes its operative position, to which it moves relative to the plug pins 7 and 8 because of its shape and its resiliency. The short-circuit element 11 extends by a shorter distance in relation to the length of the plug pins 7 and 8 into the space provided for the counter plug 5 and abuts the plug pins 7 and 8 with its arcs 12 and 13. Therefore, the plug pins 7 and 8 are electrically connected to thereby short-circuiting the electric circuit of the explosive charge 1. To improve the contact between the short-circuit element 11 and the plug pins 7 and 8, the area of the short-circuit element 11 in electrical contact with the plug pins 7 and 8 may be gold plated.

Figure 3:
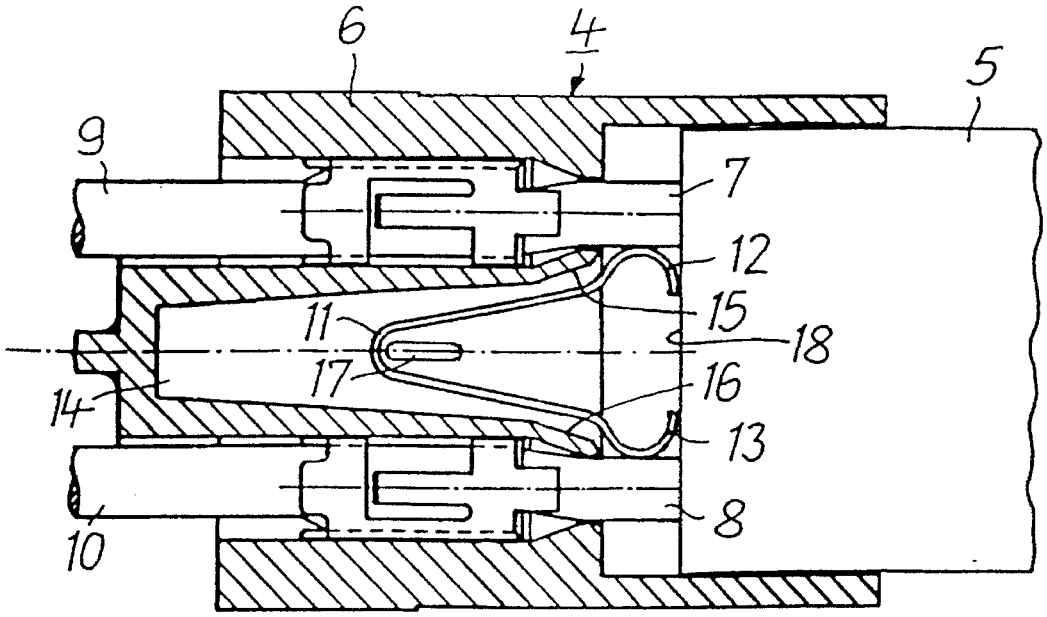
FIGS. 3 and 4 are cross-sectional views of the plug of FIG. 2 connected with a counter plug in two different positions.
Figure 4:
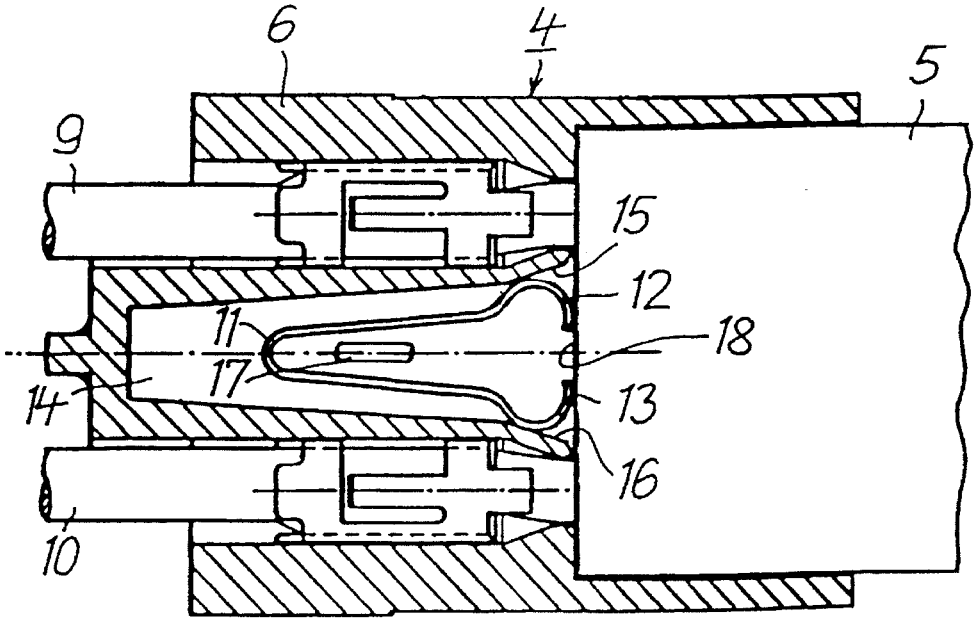

As shown in FIGS. 2 to 4, the short-circuit element 11 is installed in a cavity 14 of the insulation body 6 of the plug 4. The cavity 14 has an opening between the plug pins 7 and 8. In the area of the opening, the cavity 14 is defined by two slanting surfaces 15 and 16, which serve as guiding surfaces for the arcs 12 and 13 of the short-circuit element 11. Located in the cavity 14 is a stop 17, which is provided to limit the movement of the short-circuit element 11 in the right-hand direction of FIG. 2. Therefore, the short-circuit element is kept trapped within the plug 4.

The short-circuit of the plug pins 7 and 8 exists until the short-circuit element 11 is moved from its operative position (FIG. 2) to its inoperative position (FIG. 4) by insertion of the counter plug 5. To establish an electrical connection between the explosive charge 1 and the current source 3, the counter plug 5 is inserted into the plug 4 onto the plug pins 7 and 8. During insertion of the counter plug 5 into the plug 4, contacts—for example, electrical sockets—of the counter plug 5 electrically contact the plug pins 7 and 8 before end 18 of the counter plug 5 touches the short-circuit element 11 as shown in FIG. 3. Therefore, the electrical connection between the plug 4 and the counter plug 5 is already established before the short-circuit element 11 is moved.

As further insertion of the counter plug 5 into the plug 4 occurs, the arcs 12 and 13 slide along the slanted surfaces 15 and 16 of the cavity 14, so that the ends of the short-circuit element 11 are pressed together against the natural resiliency of the short-circuit element 11. When the counter plug 5 is brought to its fully inserted position shown in FIG. 4, corresponding to the connected state of the connecting device, the short-circuit element 11 is shifted to its inoperative position, where it does not contact the plug pins 7 and 8. The short-circuit element 11 will return automatically to its operative position shown in FIG. 2, as soon as the counter plug 5 is disconnected from the plug 4 and therefore disconnected from the plug pins 7 and 8. It will abut the plug pins 7 and 8 again, before the counter plug 5 is completely disconnected therefrom.

Thus, it can be seen from the foregoing specification and attached drawings that the present invention provides an effective means for establishing electrical contact between an explosive charge and its current source.

The preferred embodiment admirably achieves the objects of the present invention; however, it should be appreciated that departures can be made by those skilled in the art without departing from the spirit and scope of the invention which is limited only by the following claims.

What is claimed is:

1. A device to connect an explosive charge, triggerable by electric current, to a current source, the device comprising:

(a) a plug with two pins extending in parallel to each other, the plug defining a cavity to receive a short-circuit element and a space to receive a counter plug, the two pins having lengths extending into the space to receive a counter plug;

(b) a generally V-shaped resilient short-circuit element mounted in the plug and having two free ends, the short-circuit element being rectilinearly reciprocal between an operative position in electrical contact with both of the plug pins creating a short-circuit therebetween and an inoperative position out of electrical contact with at least one of the plug pins, the short-circuit element being made of a resilient metal, the short-circuit element extending in its operative position, which is determined by its shape and resilience and corresponds to a disconnected state of the device, into the space provided for a counter plug by a shorter distance in relation to the lengths of the plug pins thereby electrically contacting and creating a short-circuit between the plug pins, the short-circuit element in its inoperative position, which corresponds to a connected state of the device, is compressed into and recessed in the cavity of the plug out of electrical contact with at least one of the plug pins; and (c) a counter plug adapted to be inserted in the space of the plug to engage the free ends of the short-circuit element and move the short-circuit element rectilinearly between its operative and inoperative positions thereby compressing the short-circuit element into the cavity and to establish electrical contact with the pins of the plug in the connected state of the device, whereas the counter plug is removed from the space of the plug and is out of electrical contact with the plug pins in the disconnected state of the device.

2. A device according to claim 1, wherein the short-circuit element is constructed as a V-shaped bow, which has a semicircular shaped arc on each of its free ends.

3. A device according to claim 2, wherein the cavity has an opening between the plug pins, two slanting surfaces define the opening and serve as guiding surfaces for the arcs of the short-circuit element.

4. A device according to claim 3, wherein the plug includes a stop in the cavity to limit movement of the short-circuit element.

5. A device according to claim 4, wherein at least those areas of the short-circuit element which electrically contact the plug pins in the operative position are gold plated.

6. A device according to claim 2, wherein each semicircular shaped arc is gold plated.

7. A device according to claim 1, wherein the plug includes a stop in the cavity to limit movement of the short-circuit element.

8. A device according to claim 1, wherein at least those areas of the short-circuit element which electrically contact the plug pins in the operative position are gold plated.

9. A device according to claim 1, wherein the short-circuit element and the plug pins are dimensionally sized and positioned so that, during insertion of the counter plug, electrical contact with the plug pins in the connected state of the device is established prior to the short-circuit element being moved to its inoperative position.

* * * * *